United States Patent [19]

Inoue

[11] Patent Number: 4,929,160

[45] Date of Patent: May 29, 1990

[54] SCROLL COMPRESSOR HAVING EXHAUSTING PIPE PRESSED INTO MUFFLER CHAMBER UNDER PRESSURE

[75] Inventor: Toshinobu Inoue, Numazu, Japan

[73] Assignee: Kabushiki Kaisha Toshiba, Kawasaki, Japan

[21] Appl. No.: 239,990

[22] Filed: Sep. 2, 1988

[30] Foreign Application Priority Data

Sep. 10, 1987 [JP] Japan ..... 62-137577[U]

[51] Int. Cl.[5] ..... F04C 18/04; F04C 29/06

[52] U.S. Cl. ..... 418/55; 418/181

[58] Field of Search ..... 418/55, 181; 417/312, 417/902

[56] References Cited

U.S. PATENT DOCUMENTS 4,460,321 7/1984 Terauchi ..... 418/55 R 4,497,615 2/1985 Griffith ..... 418/55 R 4,609,334 9/1986 Muir et al. ..... 418/55 D 4,767,293 8/1988 Caillat et al. ..... 418/55 D

FOREIGN PATENT DOCUMENTS 62-165589 7/1987 Japan .

*Primary Examiner*—John J. Vrablik

*Attorney, Agent, or Firm*—Cushman, Darby & Cushman

[57] ABSTRACT

A muffler chamber being defined by a circumferential side wall member integrally and perpendicularly extending from the upper surface of a stationary scroll member and a cup-shaped upper wall member supported by the circumferential side wall member in a sealing state. An exhausting pipe is pressed into an exhausting port formed in the circumferential side wall member under pressure to reduce soldering portions of muffler chamber.

9 Claims, 4 Drawing Sheets

SCROLL COMPRESSOR HAVING EXHAUSTING PIPE PRESSED INTO MUFFLER CHAMBER UNDER PRESSURE

BACKGROUND OF THE INVENTION

1. Field of the invention

This invention relates, in general, to scroll type compressors including a stationary scroll member and a movable scroll member. In particular, the invention relates to a muffler assembly and an exhausting pipe fluidly connected to the muffler assembly.

2. Description of the related art

A conventional scroll type compressor applied to refrigerating apparatus includes following constructions, as shown in FIG. 1. The conventional scroll type compressor 11 typically includes a driving unit 13 and a compressing unit 15 respectively arranged at lower and upper portions in a casing 17. Driving unit 13 includes a stator 19 and a rotor 21 disposed in stator 19, and is mechanically connected with compressing unit 15 by a rotation shaft 23 of rotor 21. Compressing unit 15 includes a stationary scroll 25 and a movable scroll 27 engaged with stationary scroll 25 to define a plurality of compressing chambers 26. Gaseous fluid in each compressing chamber is compressed with the progress of movement toward the center of compressing unit 15 when driving unit 13 operates. The gaseous fluid in compressing chamber 26 is finally ejected into a muffler chamber 29 through a discharge opening 31 provided to the upper surface of stationary scroll 25. Muffler chamber 29 is defined by the upper surface of stationary scroll 25 and a cap structure 33. The edge portion of cap structure 33 is firmly fixed to the side surface of stationary scroll 25 by soldering. One of the ends of a connecting pipe 35 is connected to cap structure 33, and the other end thereof is connected to an exhausting pipe 37. Exhausting pipe 37 extends to the outside of casing 17 to discharge gaseous fluid in muffler chamber 29.

In the above-described conventional scroll compressor, plenty of components are used to constitute a discharge pass including muffler chamber 29, connecting pipe 35 and exhausting pipe 37. Therefore, connecting portions of the discharge pass is increased, and the process of assembling the discharge pass also is increased, resulting in the increase in manufacturing cost. A suitable space is required between exhausting pipe 37 and the peripheral components in casing 17. The external size of scroll compressor 11 can not be minimized. Leakage of gaseous fluid from the discharge pass may be increased because of the increase of the connecting portions of the discharge pass.

Another conventional scroll type compressors are disclosed in FIGS. 2 and 3. A muffler chamber 29 is disposed between a stationary scroll 25 and a casing 17. An exhausting pipe 37 is connected to muffler chamber 29 to discharge gaseous fluid from muffler chamber 29 to the outside of casing 17. Exhausting pipe 37 is soldered to cap structure 33 of muffler chamber 29, and is further soldered to casing 17 after an upper part 41 of casing 17 is assembled. The soldered portions and assembling processes also are increased.

SUMMARY OF THE INVENTION

Accordingly, it is an object of the present invention to simplify the connection of an exhausting pipe to a muffler chamber of a scroll type compressing apparatus.

To accomplish the above-object, a scroll type compressing apparatus includes a compressing section for compressing gaseous fluid. The compressing section includes a movable scroll member, and a stationary scroll member engaging with the movable scroll member for defining a compressing cell therebetween. The compressing apparatus further includes a muffler section which has a circumferential side wall member substantially perpendicularly and integrally extending from the upper wall of the stationary scroll member, a substantially cup-shaped upper wall member supported by the circumferential side wall member. The compressing apparatus includes an exhausting pipe pressed into an exhausting port formed in the circumferential side wall member under pressure. Thickness of the circumferential side wall member where the exhausting port is formed may be greater than that of other portion of the circumferential side wall member for maintaining a relatively long sealing length between exhausting pipe and exhausting port. The exhausting port may be formed such that diameter of exhausting port gradually increases toward the outer surface of the circumferential side wall member.

BRIEF DESCRIPTION OF THE ACCOMPANYING DRAWINGS

Other features and advantages of the present invention will be apparent from the following description taken in connection with the accompanying drawings wherein.

DETAILED DESCRIPTION OF THE PREFERRED EMBODIMENTS

Figure 1:
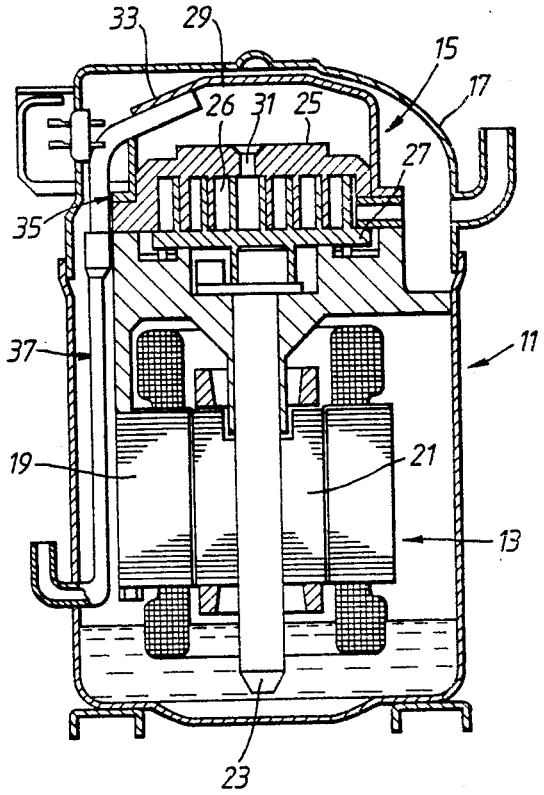
Fig. 1. PRIOR ART.
FIG. 1 is a cross sectional side view illustrating a conventional scroll type compressor.
Figure 2:
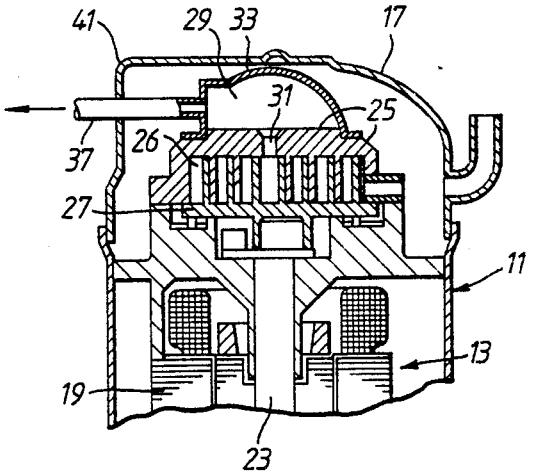
Fig. 2. PRIOR ART.
FIG. 2 is a fragmentary sectional view illustrating another conventiOnal scroll type compressor.
Figure 3:
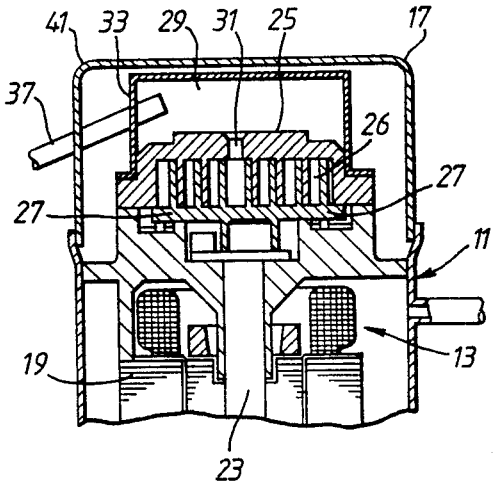
Fig. 3. PRIOR ART.
FIG. 3 is a fragmentary sectional view illustrating still another conventional scroll type compressor.
Figure 4:
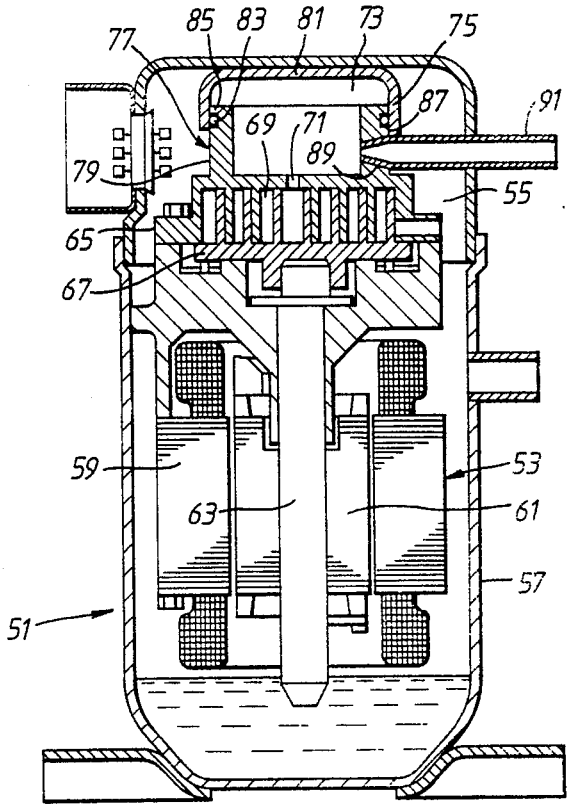
FIG. 4 is a cross sectional side view illustrating a scroll type compressor of one embodiment of the present invention.

Preferred embodiment of the present invention will now be described with reference to FIG. 4. A scroll type compressor 51 includes a compressing unit 55 and driving unit 53 which drives compressing unit 55. Driving unit 53 is disposed at the lower portion in a casing 57 of compressor 51. Driving unit 53 includes a stator 59 and a rotor 61 movably disposed in stator 59. Rotor 61 is fixed around a rotational shaft 63. Compressing unit 55 is disposed at the upper portion in casing 57, and includes a stationary scroll member 65 and a movable scroll member 67. Movable scroll member 67 and stationary scroll member 65 are movably engaged with one another to establish a plurality of compressing chambers 69 therebetween. Movable scroll member 67 is mechanically connected to rotational shaft 63 extending from driving unit 53. A discharge opening 71 is formed to the center portion of the upper wall of stationary scroll member 65. Gaseous fluid in compressing chamber 69 is compressed with the progress of movement toward the center portion of stationary and movable scroll members 65 and 67 when driving unit 53 operates. The gaseous fluid is finally discharged from discharge opening 71. A muffler chamber 73 is formed above stationary scroll member 65. Muffler chamber 73 is defined by an upper partition element 75 and a lower partition element 77 coupled to upper partition element 75. Lower partition element 77 includes the upper wall of stationary scroll member 65, and a ring-shaped side wall 79 perpendicularly and integrally extending from the upper wall of stationary scroll member 65. Upper partition element 75 includes a cup-shaped upper wall 81. The upper surface of cup-shaped upper wall 81 is in contact with casing 57. The inner edge surface of cup-shaped upper wall 81 is engaged with the outer edge surface of ring-shaped side wall 79. A groove 83 is formed in the outer edge surface of ring-shaped side wall 79. O-ring 85 is positioned in groove 83 to seal an engaged portion 87 between the inner edge surface of cup-shaped upper wall 81 and the outer edge surface of ring-shaped side wall 79 when cup-shaped upper wall 81 and ring-shaped side wall 79 are engaged with one the other. Engaged portion 87 between the inner edge surface of cup-shaped upper wall 81 and the outer edge surface of ring-shaped side wall 79 allows upper partition element 75, i e., cup-shaped upper wall 81, to move in a perpendicular direction. A discharge port 89 is formed in the lower portion of ring-shaped side wall 79 such that the diameter of discharge port 89 gradually increases from the inner surface of ring-shaped side wall 79 toward the outer surface. An exhausting pipe 91 is pressed into discharge port 89 of ring-shaped side wall 79 under pressure. Diameter of the end portion of exhausting pipe 91 gradually decreases toward the edge of exhausting pipe 91 to fit with discharge port 89. Therefore, a discharge pass is established from compressing chamber 69 to the outside of casing 57 through discharge opening of stationary scroll member 65, muffler chamber 73 and exhausting pipe 91.

With the above-described embodiment, muffler chamber 73 is defined by ring-shaped side wall 79 perpendicularly and integrally extending from the upper wall of stationary scroll member 65, and cup-shaped upper wall 81. A desirable thickness of ring-shaped side wall 79 may be maintained to insert exhausting pipe 91 into discharge port 89 of ring-shaped side wall 79 under pressure. The inner edge surface of cup-shaped upper wall 81 is movably engaged with the outer edge surface of ring-shaped side wall 79. O-ring 85 is positioned between the inner edge surface of cup-shaped upper wall 81 and the outer edge surface of ring-shaped side wall 79 to seal the engaging portion of cup-shaped upper wall 81 and ring-shaped side wall 79. A maximum volume in muffler chamber 73 may be achieved when cup-shaped upper wall 81 is moved toward the upper surface of casing 57. Furthermore, soldered portions of components which constitute muffler chamber 73 or the discharge pass can be reduced, resulting in decrease in manufacturing cost.

A second embodiment of the present invention will now be described with reference to FIG. 5. In this embodiment, cup-shaped upper wall 81 includes a flange portion 101 outwardly extending from the edge of upper wall 81. Flange portion 101 is arranged on the upper surface of ring-shaped side wall 79 to fix cup-shaped upper wall 81 on ring-shaped side wall 79 by means of bolt 103. A guide pipe 105 is fixed to a side surface of casing 57 corresponding to discharge port 89 of ring-shaped side wall 79 to guide exhausting pipe 91 when exhausting pipe 91 is pressed into discharge port 89 through casing 57 under pressure. The diameter of exhausting pipe 91 which is positioned outside of casing 57 is greater than that of other portion of exhausting pipe 91 to firmly insert a connecting pipe (not shown) of a refrigerating circuit into exhausting pipe 91.

Figure 5:
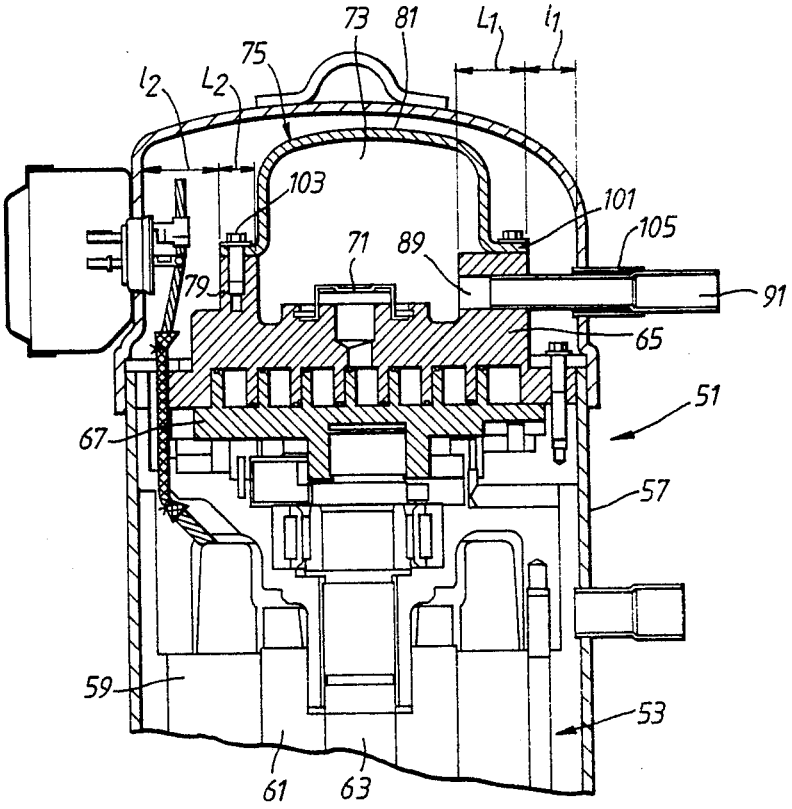
FIG. 5 is a fragmentary sectional view illustrating a scroll type compressor of second embodiment of the present invention.

As can be seen in FIG. 5, the thickness $L_1$ of ring-shaped side wall 79 where discharge port 89 is provided is greater than the thickness $L_2$ of the portion of ring-shaped side wall 79 diametrically opposite to discharge port 89. Therefore, a relatively long sealing length between exhausting pipe 91 and discharge port 89 is maintained without increasing the amount of weight of ring-shaped side wall 79 too much. Since, a distance ($l_1$) between discharge port 89 and casing 57 is small, exhausting pipe 91 is easily aligned with discharge port 89 when exhausting pipe 91 is inserted into discharge port 89 from the outside of casing 57.

With the above-described embodiment, since ring-shaped side wall 79 integrally extends from the upper surface of stationary scroll member 65, and discharge port 89 is formed in side wall 79, exhausting pipe 91 is fixed into discharge port 89 under pressure, rather than soldering.

The present invention has been described with respect to specific embodiments, however, other embodiments based on the principles of the present invention should be obvious to those of ordinary skill in the art. Such embodiments are intended to be covered by the claims.

What is claimed is:

1. A scroll type compressing apparatus comprising:

compressing means for compressing gaseous fluid, including a movable scroll member and a stationary scroll member engaging with the movable scroll member for defining a compressing cell therebetween, the stationary scroll member having an upper wall and a discharging opening formed to the upper wall for discharging gaseous fluid from the compressing cell;

muffler means for receiving gaseous fluid from the compressing cell through the discharge opening, including a circumferential side wall member substantially perpendicularly and integrally extending from the upper wall of the stationary scroll member and a substantially cup-shaped upper wall member supported by the circumferential side wall member, the circumferential side wall member having an exhausting port; and an exhausting pipe inserted into the exhausting port of the circumferential side wall member under pressure.

2. An apparatus according to claim 1, wherein the circumferential side wall member has thickness in a direction perpendicular to the extending direction thereof, a thickness of the circumferential side wall member where the exhausting port is formed being greater than that of a portion of the circumferential side wall member diametrically opposed to said exhaust port.

3. An apparatus according to claim 1, wherein the circumferential side wall member has an outer surface, and the cup-shaped upper wall member is movably engaged with the outer surface of the circumferential side wall member, the circumferential side wall member including sealing means for sealing the engaging portion of the circumferential side wall member and the cup-shaped upper wall member.

4. An apparatus according to claim 3, wherein the sealing means includes means for defining a circumferential groove at the outer surface of the circumferential side wall member, and an O-ring arranged in the circumferential groove.

5. An apparatus according to claim 1, wherein the exhausting port of the ciroumferential side wall member includes means for defining a connecting opening for connecting the exhausting pipe, the connecting opening being formed such that diameter of the connecting opening gradually increases toward the outer surface of the circumferential side wall member.

6. A scroll type compressing apparatus comprising:

a casing having an upper inner surface;

a movable scroll member disposed in the casing;

a stationary scroll member engaging with the movable scroll member for establishing a compressing cell therebetween, the stationary scroll member having an upper wall;

means for defining a discharge opening at the upper wall of the stationary scroll member;

a circumferential lower side wall substantially perpendicularly and integrally extending from the upper wall of the stationary scroll member, the circumferential lower side wall having an outer surface;

a cap member associated with the circumferential lower side wall for defining a muffler chamber, including a base plate contacting the upper inner surface of the casing when the compressing apparatus operates, and a circumferential upper side wall substantially perpendicularly extending from the base plate, the circumferential upper side wall having an inner surface movably coupled with the outer surface of the circumferential lower side wall;

an O-ring disposed between the inner surface of the circumferential upper side wall of the cap member and the outer surface of the circumferential lower side wall;

means for defining an exhausting opening at the circumferential lower side wall; and an exhausting pipe fluidly connected to the muffler chamber, the exhausting pipe being pressed into the exhausting opening of the circumferential lower side wall under pressure.

7. A scroll type compressing apparatus comprising:

a casing having an upper inner surface;

a movable scroll member disposed in the casing;

a stationary scroll member engaging with the movable scroll member for establishing a compressing cell therebetween, the stationary scroll member having an upper wall:

means for defining a discharge opening at the upper wall of the stationary scroll member;

a circumferential lower side wall substantially perpendicularly and integrally extending from the upper wall of the stationary scroll member, the circumferential lower side wall having an outer surface;

a cap member associated with the circumferential lower side wall for defining a muffler chamber, including a base plate, a circumferential upper side wall substantially perpendicularly extending from the base plate, and a flange portion extending outwardly from the extending edge of the circumferential upper side wall;

means for fixing the flange portion of the cap member to the circumferential lower side wall in a sealing state;

means for defining an exhausting opening at the circumferential lower side wall;

means for defining a guide opening at a portion of the casing corresponding to the exhausting opening; and an exhausting pipe fluidly connected to the muffler chamber, the exhausting pipe being pressed into the exhausting opening of the circumferential lower side wall under pressure through the guide opening.

8. An apparatus according to claim 7, wherein the circumferential lower side wall has thickness in a direction perpendicular to the extending direction thereof, a thickness of the circumferential lower side wall where the exhausting opening is formed being greater than that of a portion of the circumferential lower side wall diametrically opposed to said exhausting opening.

9. An apparatus according to claim 7, wherein the casing includes a guide pipe disposed in the guide opening for guiding the exhausting pipe to the exhausting opening when assembling.

* * * * *